US010247392B2

(12) United States Patent
Huang et al.

(10) Patent No.: US 10,247,392 B2
(45) Date of Patent: Apr. 2, 2019

(54) LUMINOUS SYSTEM

(71) Applicant: CHUN KUANG OPTICS CORP., Hsinchu County (TW)

(72) Inventors: Hsin-Chieh Huang, Hsinchu County (TW); Shun-Wen Teng, Hsinchu County (TW); Shun Wang, Hsinchu County (TW)

(73) Assignee: CHUN KUANG OPTICS CORP., Hsinchu County (TW)

( * ) Notice: Subject to any disclaimer, the term of this patent is extended or adjusted under 35 U.S.C. 154(b) by 301 days.

(21) Appl. No.: 14/755,848

(22) Filed: Jun. 30, 2015

(65) Prior Publication Data

US 2017/0002997 A1 Jan. 5, 2017

(51) Int. Cl.
*F21L 4/00* (2006.01)
*F21V 5/00* (2018.01)
(Continued)

(52) U.S. Cl.
CPC ..... *F21V 19/02* (2013.01); *F21V 5/006* (2013.01); *F21V 5/008* (2013.01); *F21V 5/045* (2013.01);
(Continued)

(58) Field of Classification Search
CPC . F21V 5/04; F21V 5/048; F21V 5/045; F21V 5/006; F21V 5/008; F21V 19/02;
(Continued)

(56) References Cited

U.S. PATENT DOCUMENTS 7,222,995 B1 5/2007 Bayat et al.
9,890,926 B2 * 2/2018 Preston ..... F21V 7/0091
(Continued)

FOREIGN PATENT DOCUMENTS

CN 202469588 U 10/2012
EP 2541298 A1 1/2013
(Continued)

OTHER PUBLICATIONS

Search Report dated Dec. 23, 2015 of the corresponding European patent application.

*Primary Examiner* — Erin Kryukova
(74) *Attorney, Agent, or Firm* — Chun-Ming Shih; HDLS IPR Services

(57) ABSTRACT

A luminous system is disclosure. The luminous system is used for projecting light to a plane and includes a luminous component and an angle-adjustable device. The luminous component is used for generating the light ray. The angle-adjustable device is used for adjusting luminous angle of the light ray. The angle-adjustable device is arranged between the plane and the luminous component and located on the route of the light ray, the angle-adjustable comprises a first lens element, and the first lens element comprises a light-emitting portion and a light-incident portion connected to the light-emitting portion. The light-including portion comprises a recess opposite to the light-emitting portion. An outer diameter of the light-emitting portion is larger than an outer diameter of the light-incident portion, and the outer diameter of the light-incident portion decreases along a direct away from the light-emitting portion.

9 Claims, 11 Drawing Sheets

(51) Int. Cl.

| | |
|---|---|
| ***F21V 5/04*** | (2006.01) |
| ***F21V 14/02*** | (2006.01) |
| ***F21V 17/02*** | (2006.01) |
| ***F21V 19/02*** | (2006.01) |
| ***F21Y 115/10*** | (2016.01) |

(52) U.S. Cl.
CPC ..... *F21V 17/02* (2013.01); *F21L 4/005* (2013.01); *F21V 14/02* (2013.01); *F21Y 2115/10* (2016.08)

(58) Field of Classification Search
CPC ..... F21V 14/02; F21V 14/06; F21V 14/025; F21V 14/065; F21V 29/70; F21V 13/04; F21V 1/12; F21V 1/16; F21V 1/143; F21V 29/74; F21V 29/745; F21V 29/76; F21V 29/763; F21V 29/767; F21V 29/77; F21V 29/773; F21V 29/777; F21V 29/78; F21V 17/02; F21L 4/005; F21L 4/04; F21L 4/045; F21L 4/02; F21L 4/022; F21L 4/025; F21L 4/027; F21Y 2110/10; F21S 10/00; F21S 10/005
See application file for complete search history.

(56) References Cited

U.S. PATENT DOCUMENTS

| | | | | |
|---|---|---|---|---|
| 2003/0117797 | A1* | 6/2003 | Sommers | F21V 5/006 362/237 |
| 2006/0158899 | A1 | 7/2006 | Ayabe et al. | |
| 2007/0147041 | A1* | 6/2007 | Shiratsuchi | F21V 5/007 362/268 |
| 2007/0279912 | A1* | 12/2007 | Urquhart | B63B 45/02 362/341 |
| 2009/0086498 | A1 | 4/2009 | Condon et al. | |
| 2009/0180286 | A1* | 7/2009 | Bamba | F21V 5/045 362/297 |
| 2010/0014286 | A1 | 1/2010 | Yoneda et al. | |
| 2010/0208371 | A1* | 8/2010 | Chao | F21V 14/02 359/824 |
| 2010/0259930 | A1* | 10/2010 | Yan | F21K 9/00 362/235 |
| 2012/0075870 | A1* | 3/2012 | Kayanuma | F21V 5/04 362/311.06 |
| 2012/0127710 | A1* | 5/2012 | Jurik | F21V 5/008 362/235 |
| 2012/0182711 | A1 | 7/2012 | Kolodin et al. | |
| 2013/0155666 | A1* | 6/2013 | Yeh | 362/187 |
| 2013/0208481 | A1* | 8/2013 | Sooferian | F21V 14/02 362/280 |
| 2013/0258663 | A1 | 10/2013 | Woodgate et al. | |
| 2014/0307444 | A1 | 10/2014 | Gorlinskiy et al. | |
| 2014/0321135 | A1* | 10/2014 | Chen | F21K 9/68 362/487 |
| 2014/0355273 | A1* | 12/2014 | Saito | F21V 5/04 362/309 |
| 2015/0016119 | A1* | 1/2015 | Inada | F21V 5/045 362/311.06 |
| 2015/0131288 | A1* | 5/2015 | Zhang | F21V 14/06 362/277 |
| 2015/0167935 | A1* | 6/2015 | Beghelli | F21V 5/002 362/268 |
| 2015/0211708 | A1* | 7/2015 | Stavely | F21V 5/007 348/164 |
| 2015/0362147 | A1* | 12/2015 | Schouboe | F21V 5/007 362/237 |
| 2016/0061439 | A1* | 3/2016 | Jurik | A63J 5/025 362/96 |
| 2016/0138777 | A1* | 5/2016 | Shen | F21K 9/233 362/308 |
| 2016/0312977 | A1* | 10/2016 | Jiang | F21V 5/045 |
| 2017/0074489 | A1* | 3/2017 | Jurik | F21S 10/007 |

FOREIGN PATENT DOCUMENTS

| | | | |
|---|---|---|---|
| JP | S54100757 | A | 8/1979 |
| JP | S6059406 | U | 4/1985 |
| JP | S63284045 | A | 11/1988 |
| JP | S642301 | U | 1/1989 |
| JP | H0553007 | U | 7/1993 |
| JP | 2011065766 | A | 3/2011 |
| JP | 2012059575 | A | 3/2012 |
| JP | 2012209142 | A | 10/2012 |
| JP | 2014013357 | A | 1/2014 |
| JP | 2014146570 | A | 8/2014 |
| WO | 2012144325 | A1 | 10/2012 |
| WO | 2014045188 | A1 | 3/2014 |
| WO | 2014092891 | A1 | 6/2014 |

* cited by examiner

LUMINOUS SYSTEM

BACKGROUND OF THE INVENTION

Field of the Invention

The present disclosure relates to a luminous system, and in particular to a luminous system with various focus.

Description of Related Art

Light is electromagnetic radiation within a certain portion of the electromagnetic spectrum. When a light encounters an object, they are either transmitted, reflected, absorbed, refracted depending on the composition of the object and the wavelength of the light. Flashlights or headlight are lighting apparatus for providing convergent light with high narrow light pattern. The turn signal and the taillight, however, are lighting apparatus for providing divergence light and widely light pattern.

Light emitting diode is a kind of semiconductor device, which exploits the property of direct bandgap semiconductor material to convert electric energy into light energy efficiently and has advantages of small volume, high response time, long service time, low power consumption, high stability, and is developed to replace the traditional non-directivity light tube and incandescent lamp.

The commercial lamp hold with light emitting diode usually uses a second lens to adjust light pattern of light generated from the light emitting diode. The distance between the second lens and the light emitting diode is fixed for providing an invariable light pattern, however, it is inconvenient for user to applied the lamp holder in different field.

SUMMARY OF THE INVENTION

According one aspect of the present disclosure, a luminous system is used for projecting light to a plane. The luminous system includes a luminous component and an angle-adjustable device. The luminous component is used for generating the light ray. The angle-adjustable device is used for adjusting luminous angle of the light ray. The angle-adjustable device is arranged between the plane and the luminous component and located on the route of the light ray, the angle-adjustable comprises a first lens element, and the first lens element comprises a light-emitting portion and a light-incident portion connected to the light-emitting portion. The light-including portion comprises a recess opposite to the light-emitting portion. An outer diameter of the light-emitting portion is larger than an outer diameter of the light-incident portion, and the outer diameter of the light-incident portion decreases along a direct away from the light-emitting portion.

The angle-adjustable device makes the luminous angle of the luminous system can be adjustable, thus the light pattern of the luminous system can also be adjusted according to object.

BRIEF DESCRIPTION OF DRAWING

The present disclosure can be more fully understood by reading the following detailed description of the embodiment, with reference made to the accompanying drawings as follows.

DETAILED DESCRIPTION OF THE INVENTION

Figure 1:
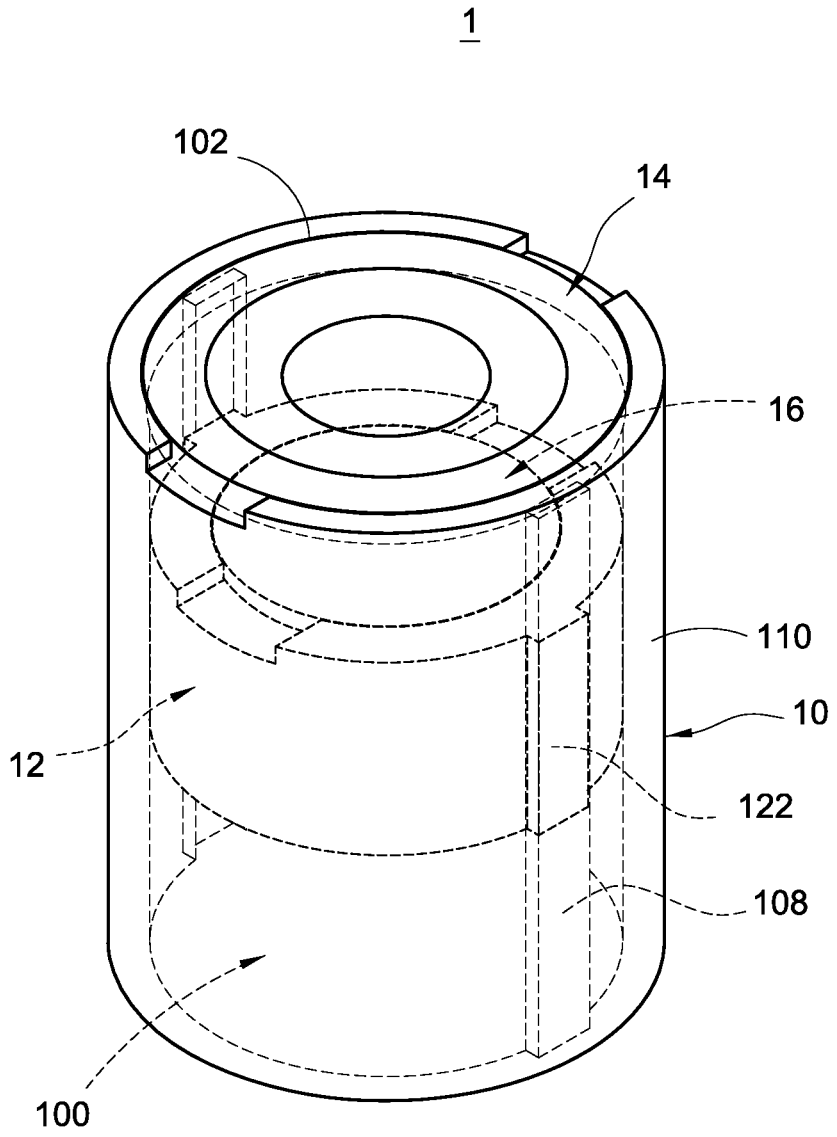
FIG. 1 is a perspective view of a luminous system according to a first embodiment of the present disclosure.
Figure 2:
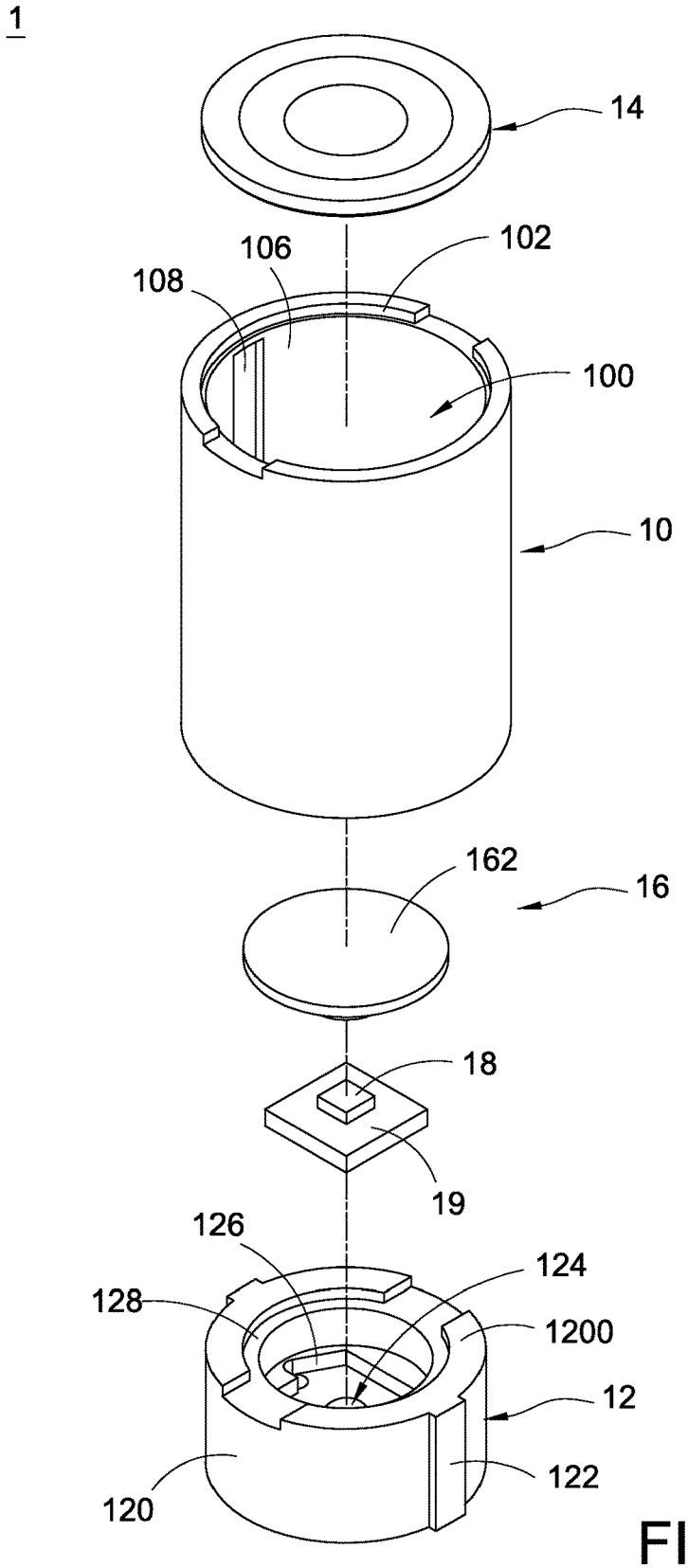
FIG. 2 is an explored view of the luminous system according to the first embodiment of the present disclosure.
Figure 3:
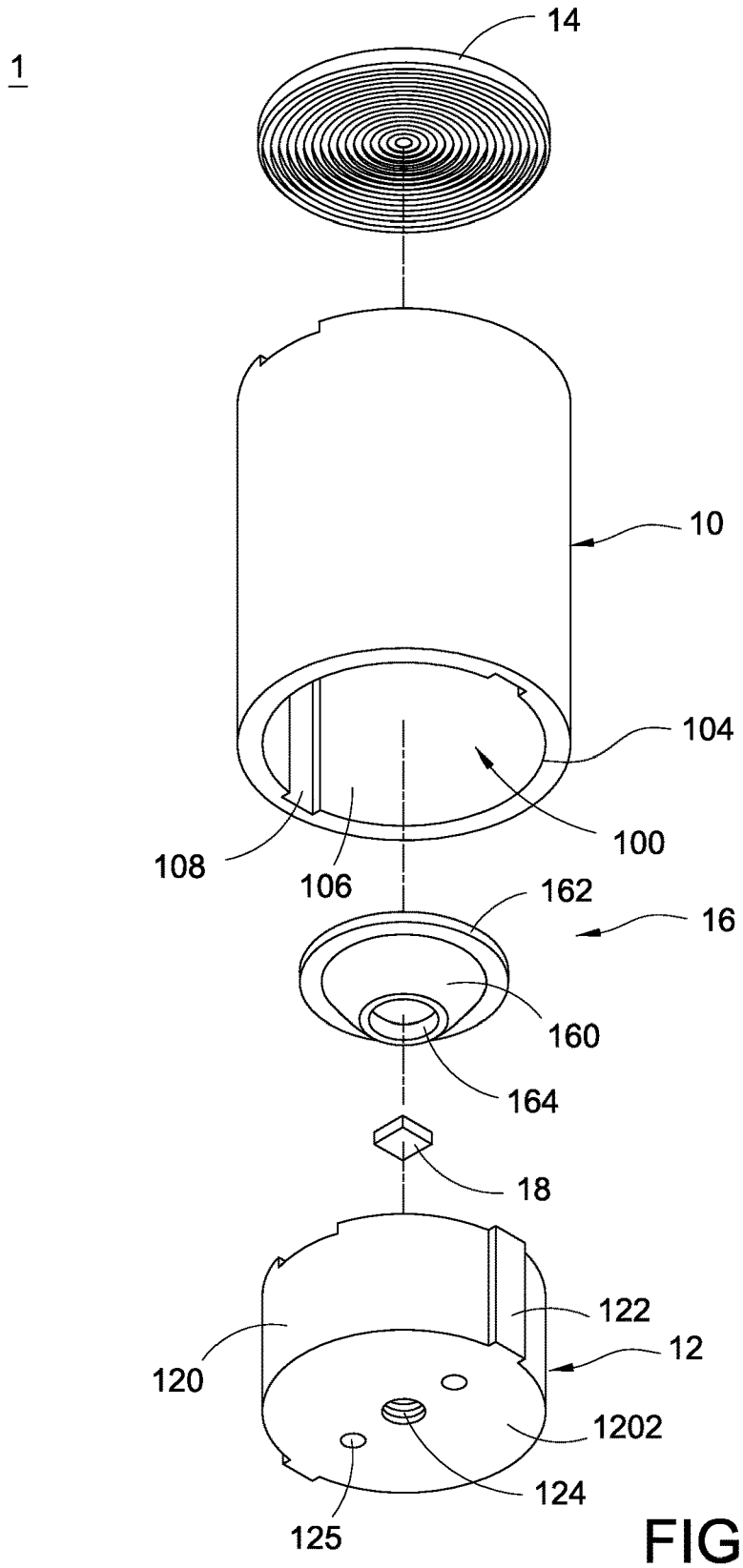
FIG. 3 is another explored view of the luminous system according to the first embodiment of the present disclosure.

Reference is made to FIG. 1, FIG. 2, and FIG. 3, wherein FIG. 1 is a perspective view of a luminous system according a first embodiment of the present disclosure, FIG. 2 and FIG.3 are assembled views of the luminous system according to the first embodiment of the present disclosure. The luminous system 1 is used to project a light ray onto a plane (such as wall, floor, ceiling, or other reference object). The luminous system 1 includes a luminous component 18 and an angle-adjustable device (it reference numeral is omitted). The angle-adjustable device is arranged between the plane and the luminous component 18, and located at an optical route of the light ray. The angle-adjustable device includes a lens barrel 10, a carrier 12, a first lens element 16, and a second lens element 14.

The profile of the lens barrel 10 is cylindrical shape. The lens barrel 10 has an accommodating space 100. An upper opening 102 (shown in FIG. 2) and a lower opening 104 (shown in FIG. 3) are formed at opposite side of the lens barrel 10 and communicating with the accommodating space 100.

The lens barrel 10 further includes a plurality of engaging slots 108 formed on an inner wall 106 thereof, and concave towards a direction from the inner wall 106 to an outer wall 110. An amount of the engaging slots 108 can be one or more, and the engaging slots 108 are arranged in a spaced arrangement. In this embodiment, the lens barrel 10 includes two engaging slots 108 faced each other, each engaging slot 108 is linear extending from the upper opening 102 to the lower opening 104, and a profile thereof is rectangular. The inner wall 106 of the lens barrel 10 can be coated with a reflecting film (not shown) for reflecting light transmitting thereon.

The carrier 12 is circular and includes engaging portions 122 formed on an outer wall 120 thereof The outer surface 120 is adjacent to the upper surface 1200 and the lower surface 1202. In this embodiment, each engaging portions 122 is protrusive from the outer wall 120 with a rectangular shape in plan view. The height of the carrier 12 is small than that of the lens barrier 10. The carrier 12 is arranged within the accommodating space 100, and the engaging portions 122 are respectively accommodated within the engaging slot 108, such that the carrier 12 can move forward or downward corresponding to upper opening 102 (or the lower opening 104).

The carrier 12 has a disposing portion 126 and a fastening portion 128 (as shown in FIG. 2) formed thereon. The fastening portion 128 concaved toward a direction of the lower surface 1202 from the upper surface 1200, and the disposing portion 126 is located at the center of the fastening portion 128 and concave toward the direction of the lower surface 1202 from the upper surface 1200. The horizontal level of the disposing portion 126 is different from that of the fastening portion 128, and in preferably, the horizontal level of the disposing portion 126 is higher than that of the fastening portion 128.

At least one penetrating hole 124 and at least one through-hole 125 are formed on the disposing portion 126, and in this embodiment, the penetrating hole 124 with circle shape is located at the center of the carrier 12.

Figure 4:
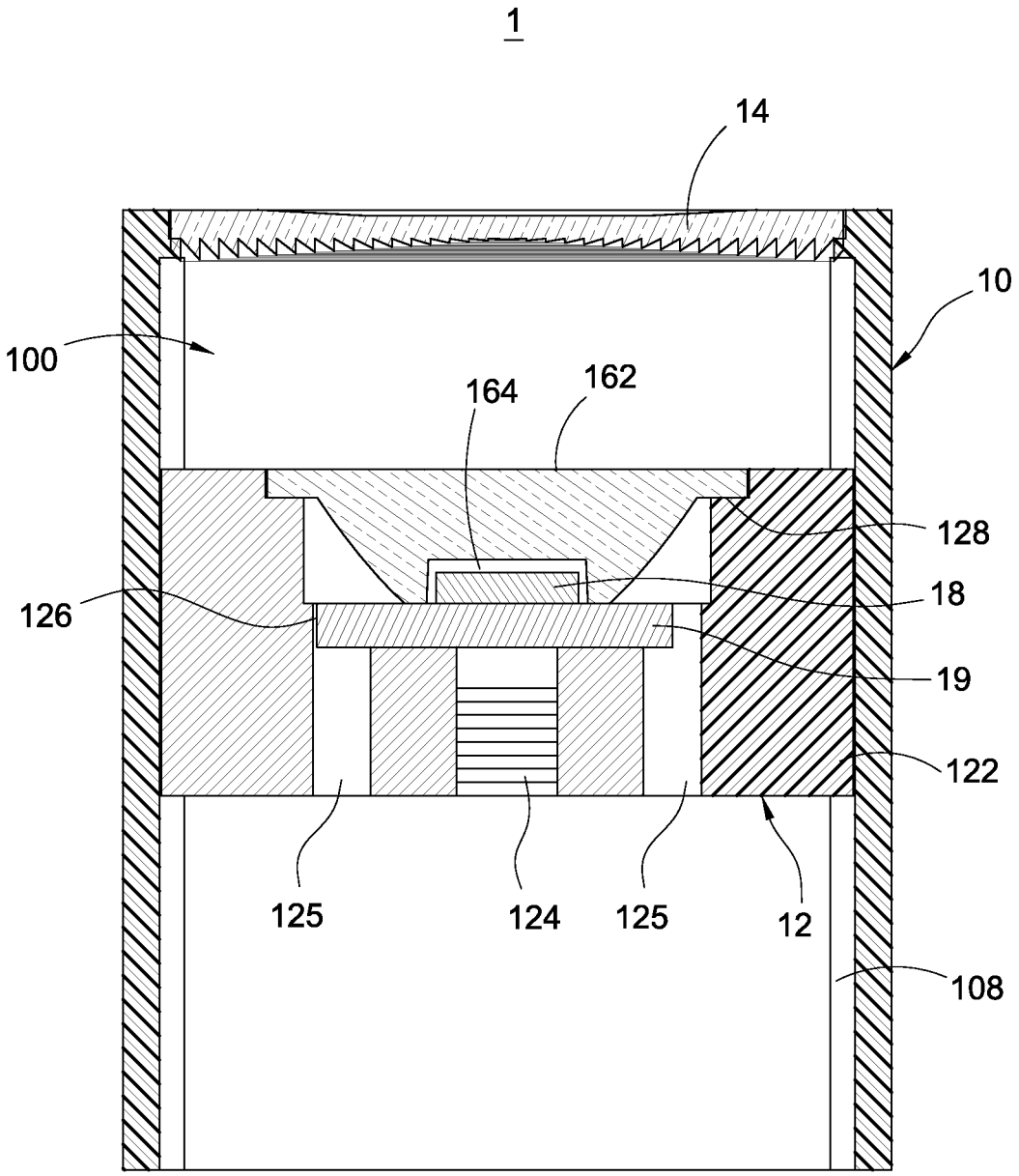
FIG. 4 is a sectional view of the luminous system according to the first embodiment of the present disclosure.

Reference is made to FIG. 4, the upper opening 102 is enclosed by the second lens element 14. The second lens element 14 is, for example, a Fresnel lens, which can effectively reduce the volume and weight of the luminous system 1. It should be noted that, the second lens element 14 can be only one lens element with refractive power or combined with multiple lens elements with refractive power.

The first lens element 16 includes a light-incident portion 160 with a frustoconical shape and a light-emitting portion 162 with a plate shape and connected to the light-incident portion 160. The outer diameter of the light-emitting portion 162 is larger than that of the light-incident portion 160, and the outer diameter of the light-incident portion 160 decreases along a direction away from the light-emitting portion 162. The light-incident portion 160 has a recess 164 formed at a direction opposite to the light-emitting portion 162. The first lens element 16 is disposed on the carrier 12, an outer edge of the light-emitting portion 162 is disposed on the fastening portion 128, and the light-incident portion 160, and the light-incident portion 160 is located at the carrier 12 and opposite to the second lens element 14. It should be noted that, the first lens element 16 can be only one lens element with refractive power or combined with multiple lens elements with refractive power.

The luminous component 18 is disposed on the disposing portion 126 and under the recess 164 for generating light ray (or called light). The luminous system 1 can further include a circuit board 19 disposed on the disposing portion 126 for carrying the luminous component 18 and transmitting electric power for the luminous component 18. The circuit board 19 can electrically connected to an external power supplier via a plurality of wires (not shown), and the wires can physically and electrically connected to the circuit board 19 via the penetrating holes 124 or the through-holes 125.

The light generated from the luminous component 18 enters the first lens element 16 from the recess 164, a part of light entering the light-incident portion 160 is directly transmitted to the light-emitting portion 162 and emitting from the light-emitting portion 162, and the other part of light is total-internal reflected by the light-incident portion 160 at first, transmitted to the light-emitting portion 162, and emitted from the light-emitting portion 162. The light exiting the first lens element 16 is then transmitted to the second lens element 14, and exits the luminous system 1.

The relative position of the carrier 12 disposed within the accommodating space 100 and the first lens element 16 (the same as a distance between the first lens element 16 and the second lens element 14) are adjustable for changing the focal length of the luminous system 1, thus light pattern of the luminous system 1 can be further modulated. The luminous system 1 is applied to flashlight or projecting light.

Figure 5:
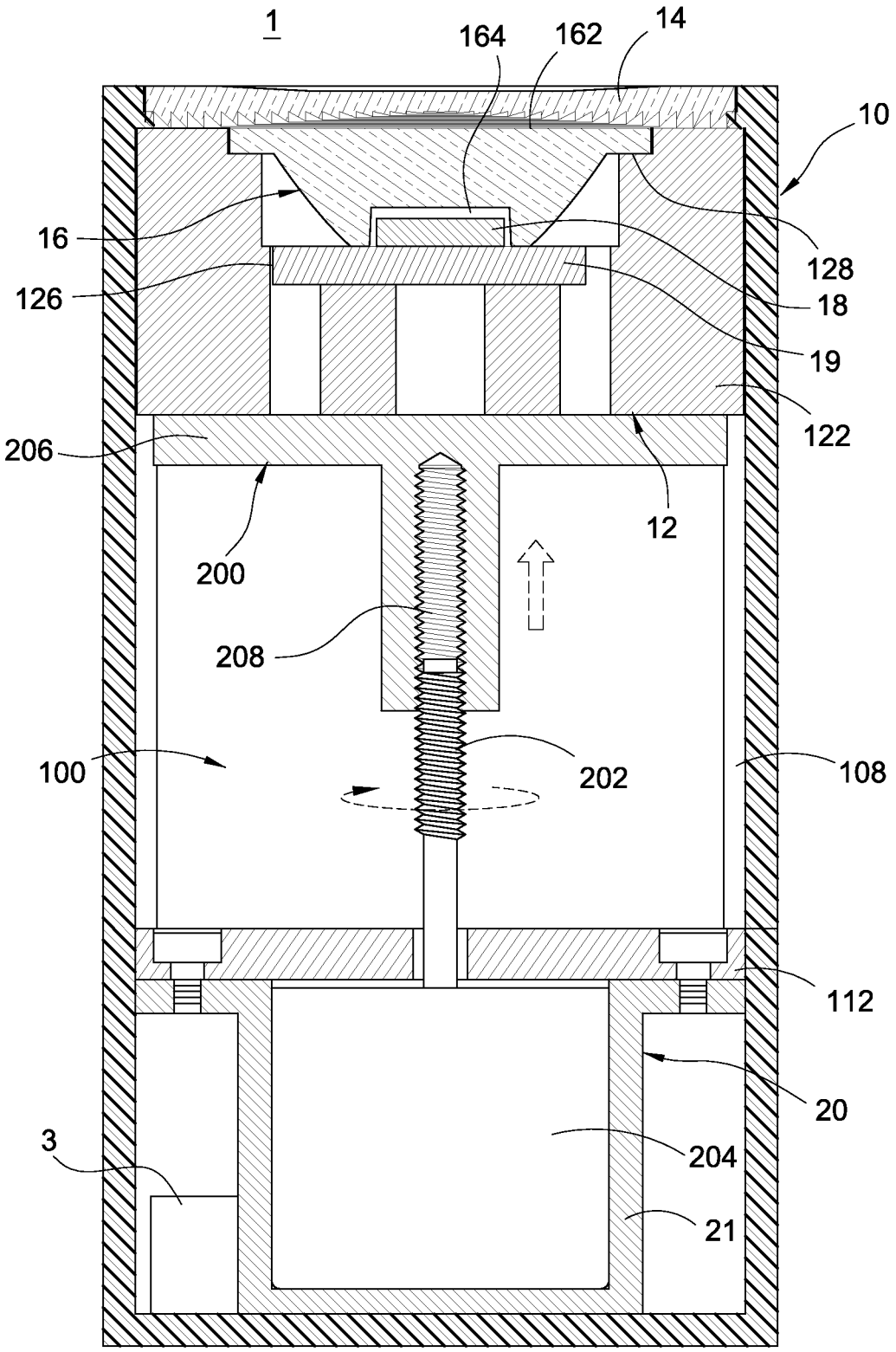
FIG. 5 is another sectional view of the luminous system according to the first embodiment of the present disclosure.

Reference is made to FIG. 5, the angle-adjustable device includes a driving unit 20. The driving unit 20 for changing the distance between the first lens element 16 and the second lens element 14 can be manual operated or connected to an automatic controlling system (not shown). In particular, the automatic controlling system can be assembled on the luminous system 1 and adjusting luminous angle thereof directly, or the automatic controlling system can adjust the luminous angle of the luminous system 1 via network, such as local area network (LAN) or internet.

The driving unit 20 includes a base 200, a screw 202, and a motor 204. The base 200 includes a platform 206 and a threaded portion 208. The platform 206 is connected to the bottom of the carrier 12 and the threaded portion 208 is connected to the center of the platform 206, such that a profile of the base 200 is of T shape. One end of the screw 202 is connected to the motor 204 packaged within a case 21 and the other end of the screw 202 is engaged with the threaded portion 208. The motor 204 is arranged within the accommodating space 100 of the barrel 10.

When the motor 204 is driven, the screw 202 is then rotated, so as to rotate the threaded portion 208 to drive the carrier 12 to slide upwards and downwards. Therefore, the distance between the first lens element 16 and the second lens element 14 is changed, so as to adjust luminous angle of the luminous system 1.

The luminous system 1 can further includes a wireless controlling module, such as Bluetooth controlling module, radio frequency identification (RFID) module, or Zigbee module, thus user can remotely operate the luminous system 1 by changing the distance between the first lens element 16 and the second lens element 14. The wireless controlling module is, for example, includes a wireless receiver 3 and the wireless emitter (not shown), and the wireless receiver 3 can be assembled within the barrel 10 of the luminous system 1 and electrically connected to the motor 20, thus the motor 20 can be driven and then changing the distance between the first lens element 16 and the second lens element 14 while the wireless receiver 3 received a signal from the wireless emitter.

Figure 6:
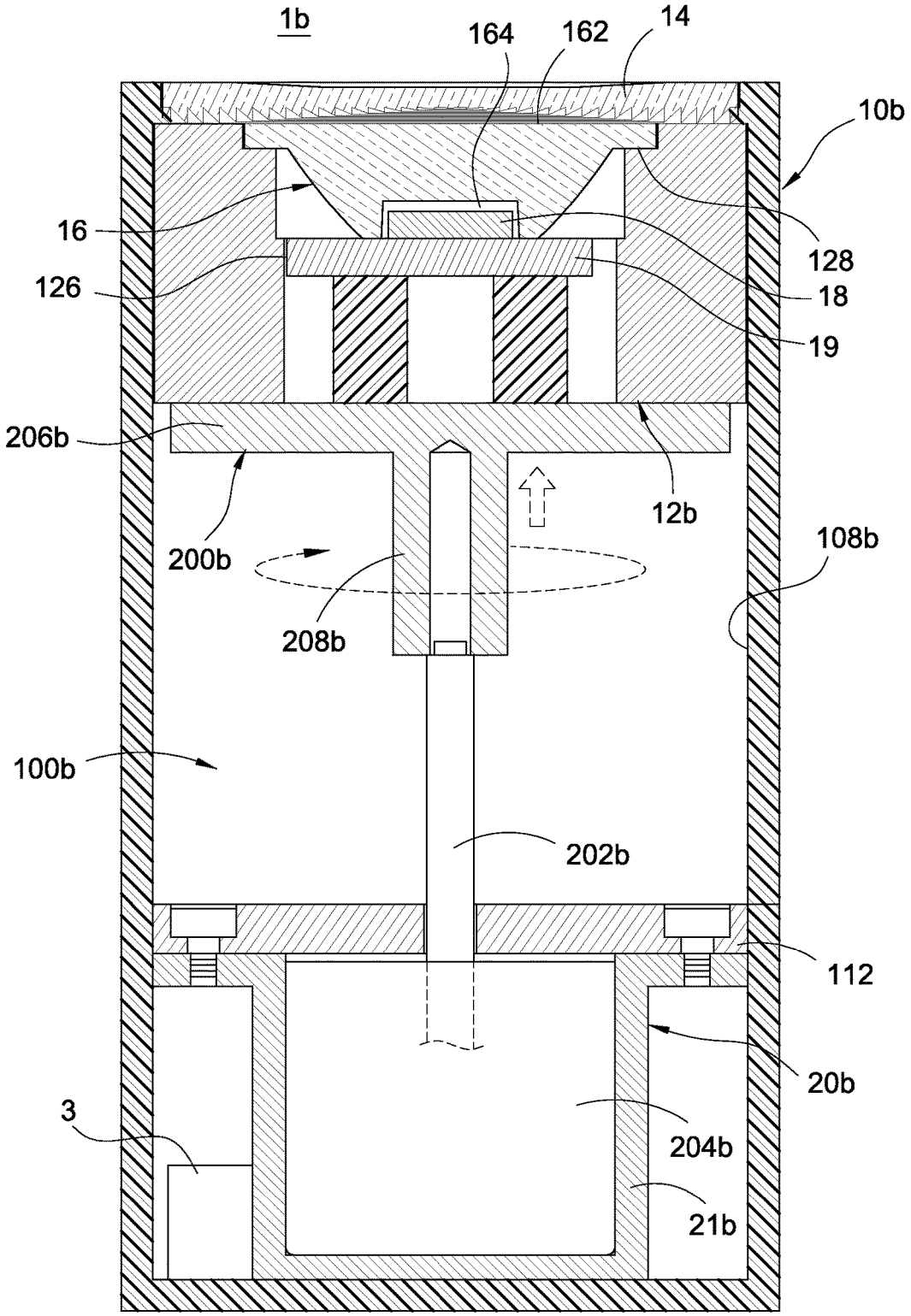
FIG. 6 is a sectional view of a luminous system according to a second embodiment of the present disclosure.
Figure 7:
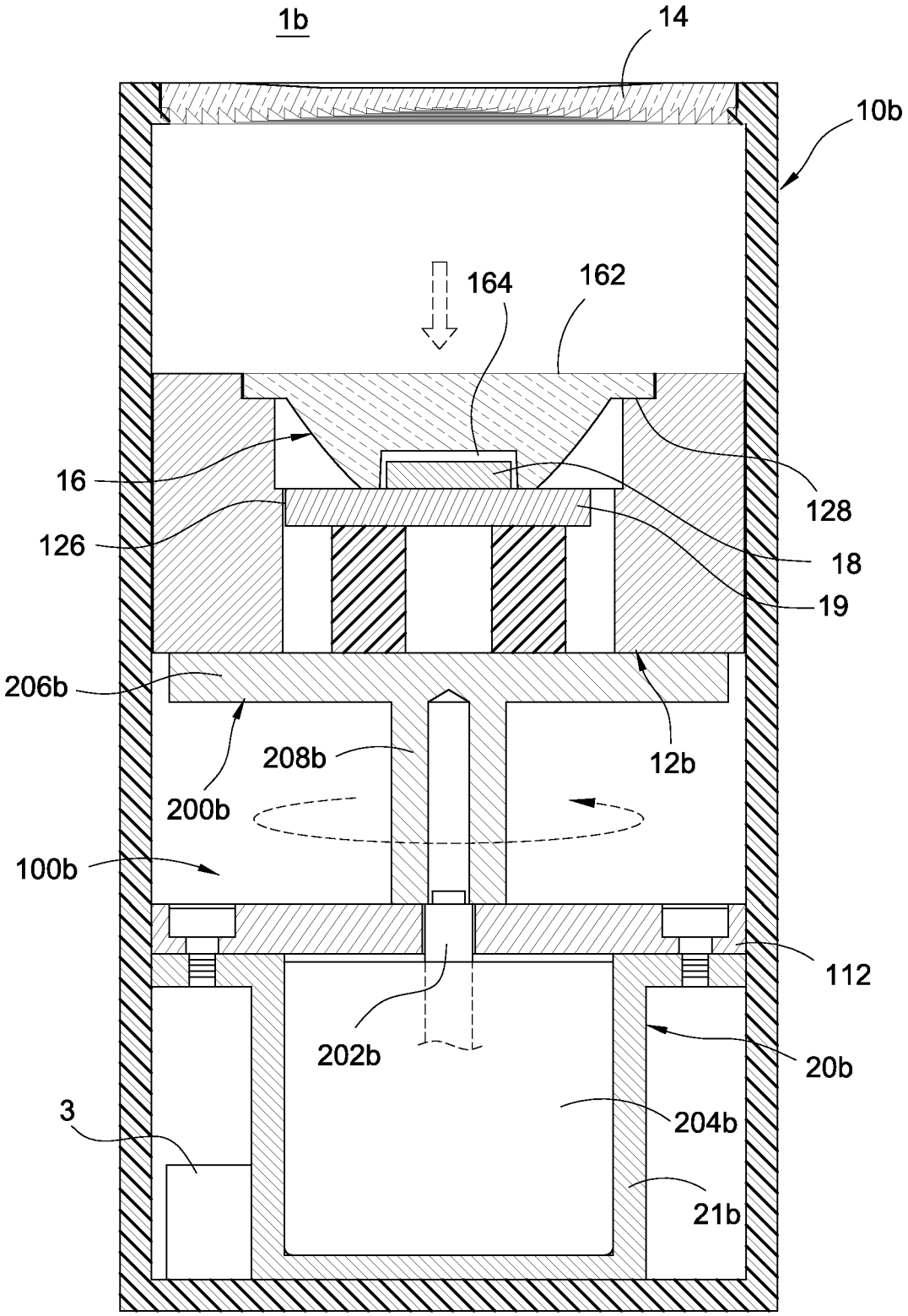
FIG. 7 is another sectional view of a luminous system according to the second embodiment of the present disclosure.

Reference is made to FIG. 6 and FIG. 7, which are respectively sectional views of a luminous system according to a second embodiment of the present disclosure. The luminous system 1*b* is similar to the luminous system 1 mentioned in the first embodiment, and the same reference numbers are used in the drawings and the description to refer to the same parts. It should be noted that the differences between the luminous system 1*b* in this embodiment and the luminous system 1 in the first embodiment is the barrel 10*b*, the carrier 12*b*, and the driving unit 20*b*.

An inner wall 108*b* of the barrel 10*b* is a smooth surface, which means that there is no engaging slot formed on the inner wall 108*b*. Besides, there is no engaging portion formed on the outer wall of the carrier 12*b*. Therefore, the carrier 12*b* not only can move upwards and downwards within the accommodating space 100*b*, but also can rotate within the accommodating space 100*b*.

The driving unit 20*b* includes a base 200*b*, a connecting rod 202*b*, and a motor 204*b*. The base 200*b* includes a platform 206*b* and a connected portion 208*b*, the platform 206*b* is connected to the bottom of the carrier 12*b*, and the connecting portion 208*b* is connected to the center of the platform 206*b*, such that a profile of the base 200*b* is substantially of T shape. One end of the connecting rod 202*b* is connected to the motor 204*b* packaged within a case 21*b*, and the other end of the connecting rod 202*b* is connected to the connecting portion 208*b*.

When the motor 204*b* is driven, the connecting rod 202*b* is then rotated and moved, so as to rotate and slide upwards and downwards the platform 206*b* to drive the carrier 12*b* to rotate and slide upwards and downwards. Therefore, the distance between the first lens element 16 and the second lens element 14 is changed, so as to adjust luminous angle of the luminous system 1*b*.

Moreover, the motor 204*b* can be driven by network, such as LAN or Internet, and then adjusting the distance between the first lens element 16 and the second lens element 14 accordingly. Furthermore, the motor 204*b* can be electrically connected to a wireless receiver 3, and driven by a driving signal sent from the wireless receiver 3 while the wireless receiver 3 received a wireless signal sent from a wireless emitter (not shown), and then adjusting the distance between the first lens element 16 and the second lens element 14 accordingly.

Figure 8:
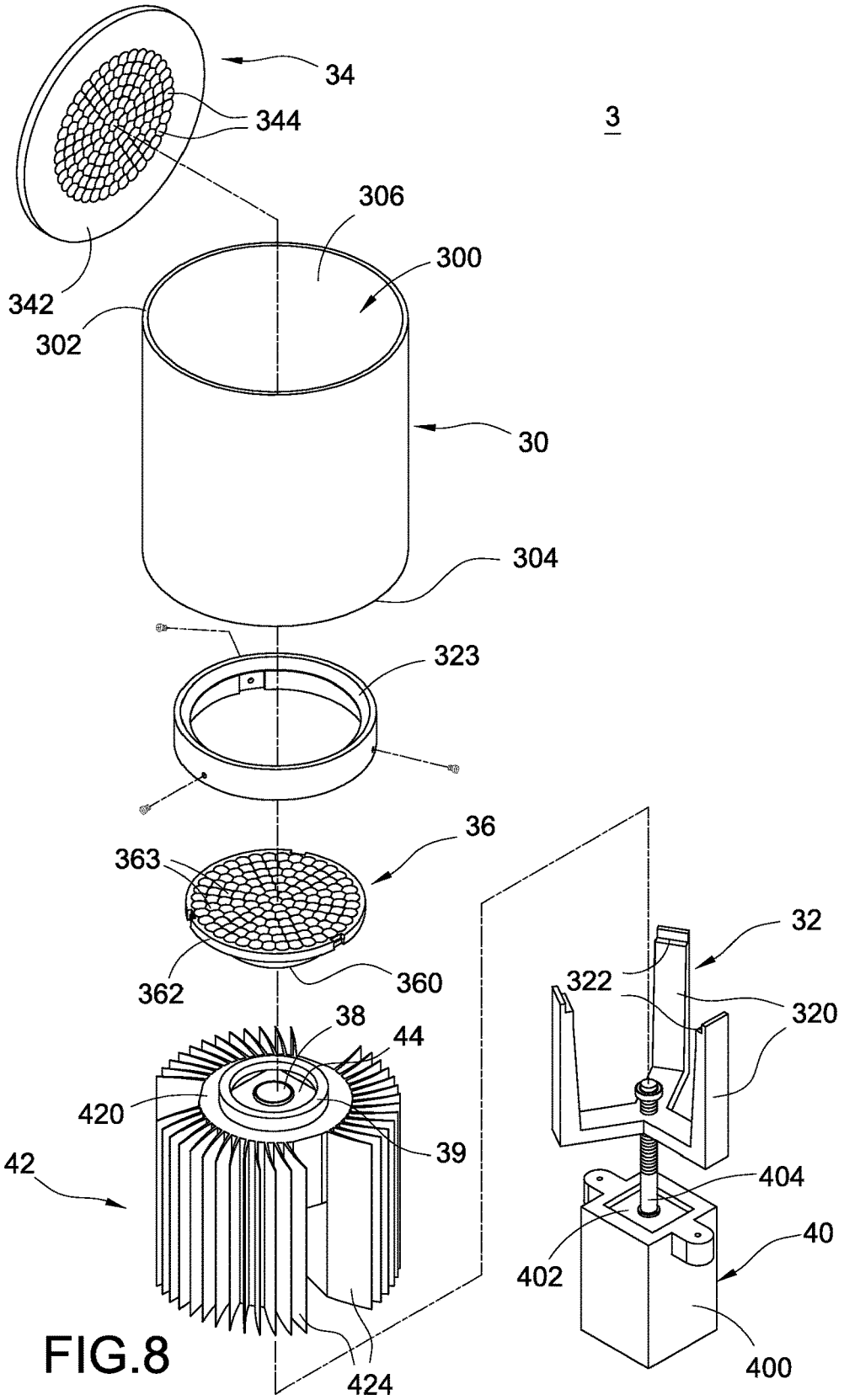
FIG. 8 is a perspective view of a luminous system according to a third embodiment of the present disclosure.
Figure 9:
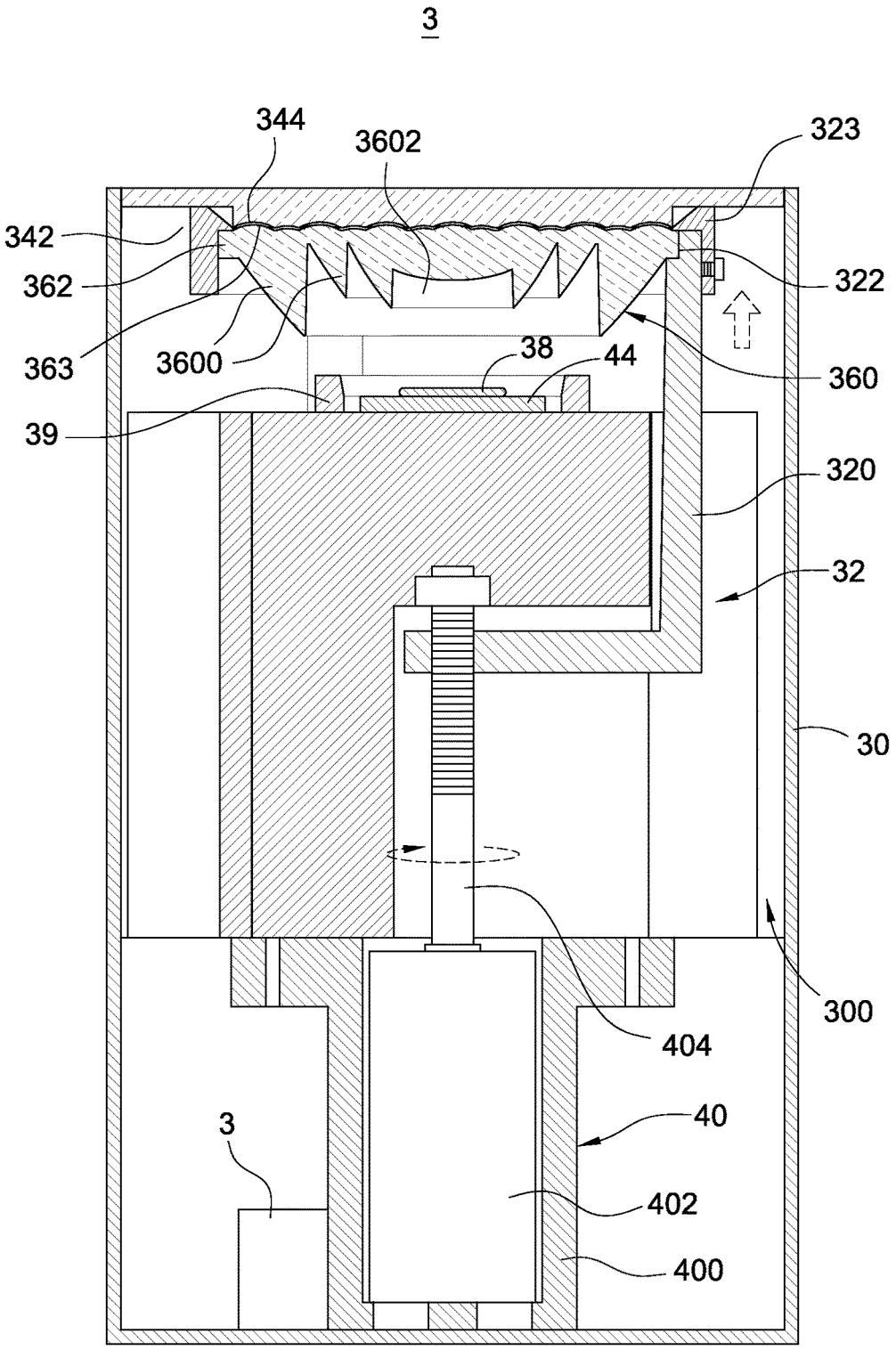
FIG. 9 is a sectional view of the luminous system according to the third embodiment of the present disclosure.
Figure 10:
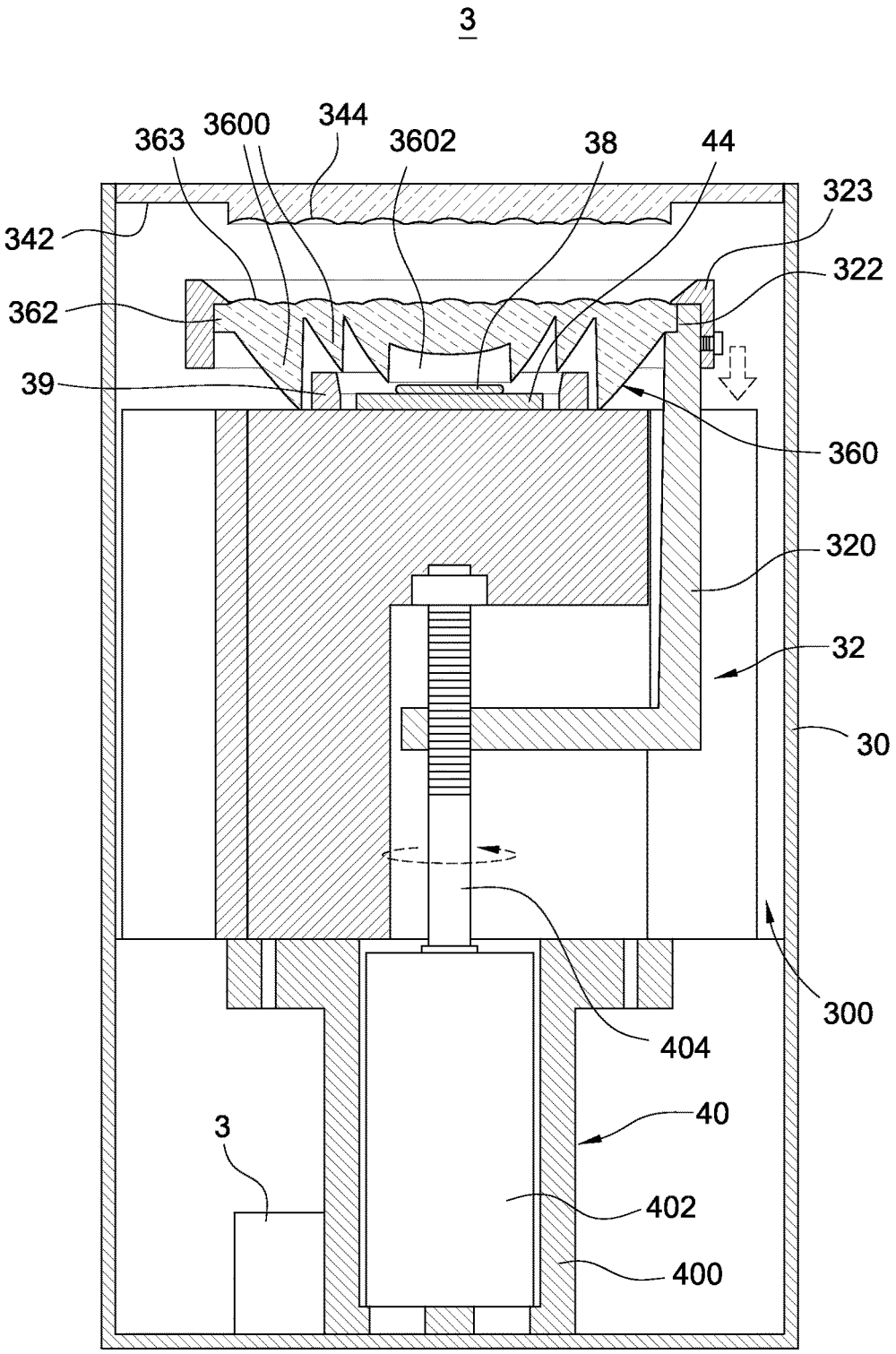
FIG. 10 is another sectional view of the luminous system according to the third embodiment of the present disclosure.

Reference is made to FIG. 8 and FIG. 9, which are respectively a perspective view and a sectional view of a luminous system according to a third embodiment of the present disclosure. The luminous system 3 is used to project a light ray (or called light) onto a plane (not shown). The luminous system 3 includes a luminous component 38 and an angle-adjustable device (it reference numeral is omitted). The angle-adjustable device for adjusting luminous angle is arranged between the plane and the luminous component 38, and located at an optical route of the light ray.

The angle-adjustable device includes a barrel 30, a carrier 32, a first lens element 36, a second lens element 34, a driving unit 40, and a heat-dissipating component 42. The barrel 30 being symmetrical has a profile of cylindrical shape. The lens barrel 30 has an accommodating space 300. An upper opening 302 and a lower opening 304 are formed at opposite side of the lens barrel 30 and communicating with the accommodating space 300. The inner wall 306 of the lens barrel 30 can be coated with a reflecting film (not shown) for reflecting light transmitting thereon.

The carrier 32 is used for supporting the first lens element 36 onto the luminous component 38. When the driving unit 40 is driven, the connecting rod 404 thereof is then slid, so as to drive the first lens element 36 to slide upwards and downwards from the second lens element 34 within the accommodating space 300.

The upper opening 302 is enclosed by the second lens element 34. The second lens element 34 has a plurality of micro-lenses 344 formed on a bottom surface thereof. The micro-lenses 344 are arranged in a concentrical manner, wherein each of the micro-lenses 344 can be with positive refractive power or negative refractive power.

The first lens element 36 is disposed on the carrier 32. In this embodiment, the first lens element 36 includes a light-incident portion 360 and a light-emitting portion 362. The outer diameter of the light-emitting portion 362 is larger than that of the light-incident portion 360, and the outer diameter of the light-incident portion 360 decreases along a direction away from the light-emitting portion 362. The light-incident portion 360 has a plurality of light-guiding areas 3600 and a recess 3602 formed at a direction opposite to the light-emitting portion 362.

The light-emitting portion 362 has a plurality of sub-lenses 363 formed in a surface close to the second lens element 34 and aligned with the micro-lenses 344. As shown in FIGS. 8 and 9, each of the micro-lenses 344 is concave towards a direction opposite to the first lens element 36, and the sub-lenses 363 is protruded towards the second lens element, wherein each micro-lens 344 can have negative refractive power, and each sub-lens 363 may have positive refractive power. However, each of the micro-lenses 344 can have positive refractive power and is protrude towards the first lens element 36, and each of the sub-lenses 363 can have negative refractive power and is concave toward a direction from the light-emitting portion to the light-incident portion. In the manners mentioned above, when the distance between the first lens element 36 and the second lens element 34 is zero, the sub-lenses 363 are contact with the micro-lenses 344. In the practical applications, the micro-lenses 344 and the sub-lenses 363 can be both with positive refractive power or negative refractive power.

The light-guiding areas 3600 surround the recess 3602 in a concentrical manner for total-internal-reflecting light transmitting thereon to adjust transmitting direction of light, thus light generated from the luminous component can be transmitted toward a direction of the light-emitting portion 362.

The carrier 32 includes a plurality of fixing arms 320. As can be shown in FIG. 8, the carrier 32 includes three fixing arms 320. A top end of each fixing arms 320 has a supporting portion 322 and an engaging component 323, which collectively fix the first lens element 36 by nipping an outer edge of the light-emitting portion 362. Thus, when the motor 402 is driven, the first lens element 36 can slide upward and downwards from the second lens element 34.

The heat-dissipating component 42 includes a cylinder 420 and a plurality of fins 424 formed on the outer wall of the cylinder in a radiative manner. The heat-dissipating component 42 is located between the driving unit 40 and the first lens element 36, and the fixing arms 320 of the carrier 32 pass through the opening formed on the heat-dissipating component 42 and supporting the first lens element 36 onto the heat-dissipating component 42.

The luminous system 3 can further include a circuit board 44 for carrying the luminous component 38 and transmitting electric power to the luminous component 38. The circuit board 44 is disposed on the top surface of the cylinder 420.

The driving unit 40 includes a housing 400, a motor 402, and a connecting rod 404. The motor 402 is disposed within the housing 400, one end of the connecting rod 404 is connected to the motor 402, and the other end thereof is connected to the carrier 32. When the motor 402 is driven, the connecting rod 404 drives the carrier slide upwards and downwards to adjust the distance between the first lens element 36 and the second lens element 34.

The luminous system 3 can also include a wireless controlling module, such as an infrared controlling module, Bluetooth controlling module, or Zigbee module, thus the distance between the first lens element 36 and the second lens element 34 can be adjusted by remotely controlling. The fixing component has a sliding range since the allocation of the heat-dissipating component 42, and the motor 402 is automatically ceased when reach the sliding range. Besides, the wireless controlling module can also make the motor stop sliding when an abnormal voltage signals or an abnormal current signals is reach the luminous system 3 to prevent the luminous system 3 from damage.

It should be noted that the luminous system can be operated without the second lens element 34. In the other words, the light pattern of the luminous system can be adjusted by adjusting the distance between the first lens element 36 and the luminous component 38.

Figure 11:
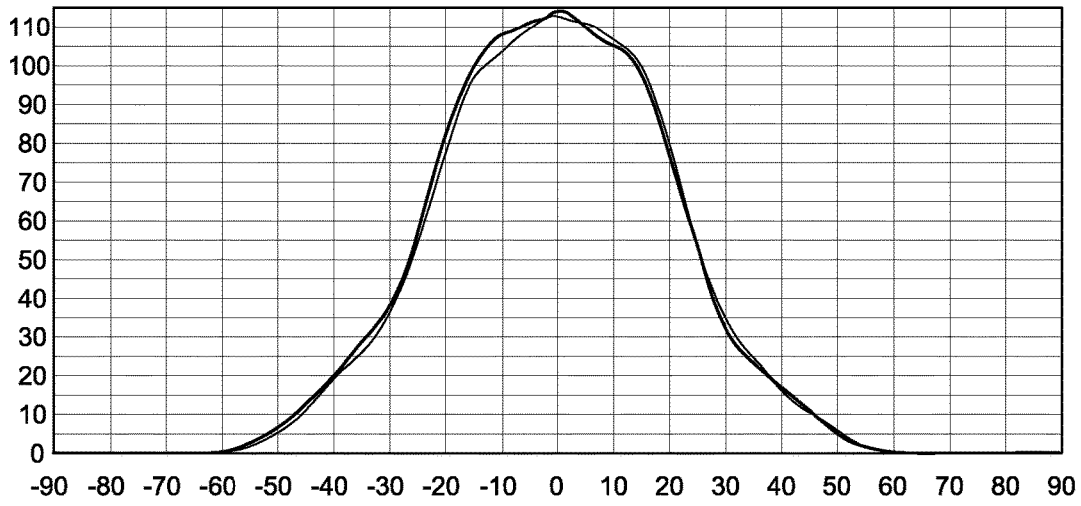
FIG. 11 is a schematic view of the luminous intensity distribution of the luminous system according to the present disclosure.
Figure 12:
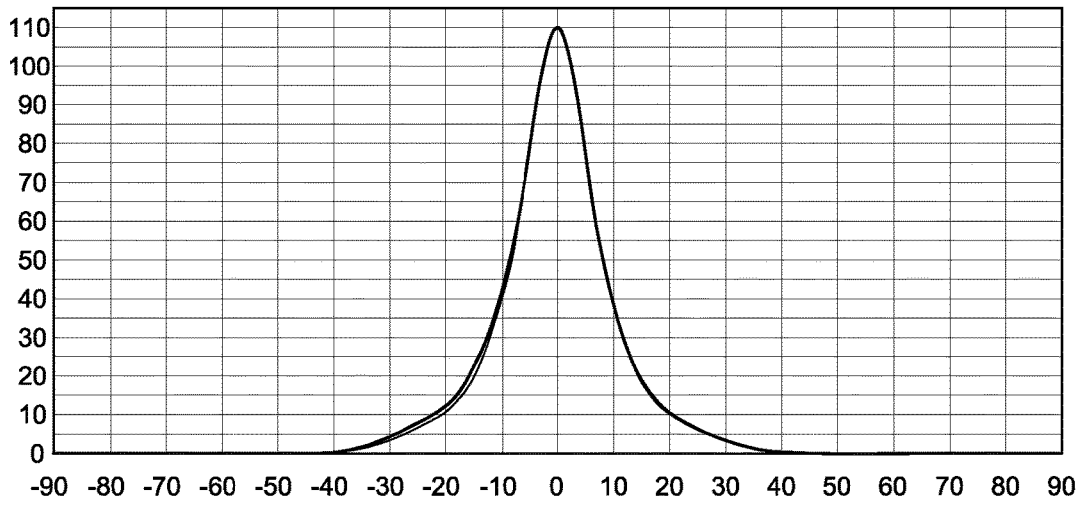
FIG. 12 is another schematic view of the luminous intensity distribution of the luminous system according to the present disclosure.

Reference is made to FIG. 11 and FIG. 12, wherein FIG. 11 is a schematic view of the luminous intensity distribution of the luminous system while the bottom edge of the first lens element 36 is aligned with the lower surface of the circuit board 44, and FIG. 12 is another schematic view of the luminous intensity distribution of the luminous system while the distance between the bottom edge of the first lens element 36 and the lower surface of the circuit board 44 is 2.8 millimeters. As can be shown in FIG. 11, light passing through the first lens element 36 distributes in 49 degrees from the optical axis when the first lens element 36 is close to the luminous component 38. In this manner, a lot of light will pass through the recess 3602 and the light-guide areas 3600 close to the recess 3602. However, when the first lens element 36 is far away from the luminous component 38, light will refract by the light-guide areas 3600 and the recess 3602, and total-internal-reflect by the light-incident portion 360, thus non-uniform luminous distribution with a ring pattern is generated.

In order to overcome the non-uniform luminous distribution, the luminous system 3 can further includes a reflection baffle 39, thus scattering light with larger luminous angle can be eliminated, wherein the reflection baffle 39 surrounds the luminous component 38 and disposed under the recess 3602.

As can be shown in FIG. 12, light passing through the first lens element 36 distributes in 15.5 degrees from the optical axis when the distance between the first lens element 36 and the luminous component 38 is 2.8 millimeters. In this manner, light generated from the luminous component 38 goes through the light-guiding areas 3600 and the recess 3602, and the light-incident portion 360 controls luminous angle. To sum up, when the distance between the bottom edge (or bottom surface) of the first lens element 36 and the lower surface of the circuit board 44 gradually increases, light passing through the first lens element 36 is convergence at a direction along the optical axis accordingly.

Although the present invention has been described with reference to the foregoing preferred embodiment, it will be understood that the invention is not limited to the details thereof Various equivalent variations and modifications can still occur to those skilled in this art in view of the teachings of the present invention. Thus, all such variations and equivalent modifications are also embraced within the scope of the invention as defined in the appended claims.

What is claimed is:

1. A luminous system used for projecting a light ray to a plane, the luminous system comprising:

a luminous component for generating the light ray;

an angle-adjusting device arranged between the plane and the luminous component and located on the route of the light ray, the angle-adjusting device comprising a first lens element, the first lens element comprising a light-emitting portion and a light-incident portion connected to the light-emitting portion, the light-incident portion comprising a recess opposite to the light-emitting portion; and a reflection baffle disposed under the recess and surrounding the luminous component;

wherein an outer diameter of the light-emitting portion is larger than an outer diameter of the light-incident portion, and the outer diameter of the light-incident portion decreases along a direction away from the light-emitting portion, wherein the light-incident portion further comprises a plurality of light-guiding areas surrounding the recess in a concentrical manner for total-internal-reflecting light transmitting thereon to adjust a transmitting direction of the light ray, thus the light ray generated from the luminous component is transmitted toward a direction of the light-emitting portion; and wherein the angle-adjusting device further comprises a carrier; the first lens element is disposed on the carrier; the carrier comprises a plurality of fixing arms, a ring-shaped engaging component and a plurality of screws; the fixing arms comprise a plurality of supporting portions; the ring-shaped engaging component and the supporting portions are screwed through the screws to collectively fix the first lens element by nipping an outer edge of the light-emitting portion; the outer edge of the light-emitting portion is arranged on the supporting portions and is clamped by the ring-shaped engaging component and the supporting portions.

2. The luminous system of claim 1, wherein the angle-adjusting device further comprising a second lens element arranged between the first lens element and the plane.

3. The luminous system of claim 2, wherein the light-emitting portion comprising a plurality of sub-lenses formed on a surface thereof away furthest from the light-incident portion.

4. The luminous system of claim 3, wherein the second lens element comprises a light-incident surface close to the first lens element, a light-emitting surface opposite to the light-incident surface, and a plurality of micro-lenses formed on the light-incident surface and aligned with the sub-lenses.

5. The luminous system of claim 1, wherein the angle-adjusting device further comprises a driving unit, and the driving unit is connected to the carrier for adjusting a distance between the first lens element and a luminous component to adjust the luminous angle of the light ray.

6. The luminous system of claim 5, further comprising a wireless receiver electrically connected to the driving unit.

7. The luminous system of claim 5, further comprising a lens barrel, the lens barrel has an accommodating space, an upper opening, and a lower opening, the upper opening and the lower opening are communicating with the accommodating space, and the plane is close to the upper opening, the luminous component and the angle-adjusting device are respectively arranged within the accommodating space.

8. The luminous system of claim 7, wherein a driving module comprises a motor and a connecting rod, the connecting rod is connected to the motor, and the ring-shaped engaging component and the connecting rod collectively fix the first lens element.

9. The luminous system of claim 8, further comprising a heat dissipating component, the heat dissipating component comprising a plurality of fins formed on an outer surface thereof, wherein the motor is located at one side of the heat dissipating component, the luminous component is located at the other side of the heat dissipating component, and the connecting rod is used to support the first lens element and passes through an opening formed between the fins.

* * * * *